US009133799B2

(12) United States Patent
Takasaki et al.

(10) Patent No.: US 9,133,799 B2
(45) Date of Patent: Sep. 15, 2015

(54) ATTACHING METHOD OF FUEL RAIL ASSEMBLY FOR DIRECT-INJECTION ENGINE

(75) Inventors: Nobuaki Takasaki, Hiroshima (JP); Shigeki Yamashita, Hiroshima (JP); Yuzo Uotani, Hiroshima (JP); Takashi Miyata, Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 504 days.

(21) Appl. No.: 13/556,999

(22) Filed: Jul. 24, 2012

(65) Prior Publication Data

US 2013/0036607 A1 Feb. 14, 2013

(30) Foreign Application Priority Data

Aug. 9, 2011 (JP) ..... 2011-173547

(51) Int. Cl.
*F02M 61/14* (2006.01)
*F02M 55/02* (2006.01)

(52) U.S. Cl.
CPC ..... *F02M 55/025* (2013.01); *F02M 61/14* (2013.01); *F02M 2200/857* (2013.01); *Y10T 29/49231* (2015.01)

(58) Field of Classification Search
CPC ..... F02M 61/145; F02M 2200/85; F02M 2200/857; F02M 55/025; F02M 61/14; F02M 61/168; Y10T 29/49231
USPC ..... 29/888.01, 450, 451, 446, 356, 29/890.143, 281.1, 469, 888.4; 123/456, 123/470; 81/469, 57.36
See application file for complete search history.

(56) References Cited

U.S. PATENT DOCUMENTS 6,148,797 A * 11/2000 Gmelin ..... 123/456
6,220,217 B1 4/2001 Kato (Continued)

FOREIGN PATENT DOCUMENTS

JP 2002-122055 A 4/2002
JP 2003-239828 A 8/2003

(Continued)

OTHER PUBLICATIONS

An English language translation of an Office Action issued by the German Patent Office on Nov. 17, 2014, which corresponds to German Patent Application No. 10 2012 014 097.5 and is related to U.S. Appl. No. 13/556,999.

*Primary Examiner* — Sarang Afzali
*Assistant Examiner* — Ruth G Hidalgo-Hernande
(74) *Attorney, Agent, or Firm* — Studebaker & Brackett PC

(57) ABSTRACT

An injector comprises a cylindrical body portion, a holding ring capable of centering an axial center of the injector, and a small-diameter cylindrical portion. There are provided an assembly forming step of forming a fuel rail assembly by inserting the injectors into respective cup portions via spring members for reaction force absorption, a press inserting step of pressing and inserting respective tip-side portions of the injectors by pressing pressure-receiving portions such that the respective spring members are compressed up to a middle compressive state thereof with a pressing movable apparatus which is capable of pressing the pressure-receiving portions of a fuel rail via respective pressing springs, and a fastening step of fastening plural boss portions concurrently to a cylinder head in a state in which a pressing force of the press inserting step is maintained.

7 Claims, 8 Drawing Sheets

(56) References Cited

U.S. PATENT DOCUMENTS

| | | | | |
|---|---|---|---|---|
| 6,263,863 | B1 | 7/2001 | Giovannini et al. | |
| 6,418,617 | B2 * | 7/2002 | Taylor | 29/888.01 |
| 7,143,749 | B1 * | 12/2006 | Colletti | 123/469 |
| 2006/0027013 | A1 | 2/2006 | Mizorogi et al. | |
| 2009/0188470 | A1 * | 7/2009 | Rettig | 123/470 |

FOREIGN PATENT DOCUMENTS

| | | | |
|---|---|---|---|
| JP | 2004-286010 | A | 10/2004 |
| JP | 2006-125293 | A | 5/2006 |
| JP | 2010-019132 | A | 1/2010 |
| JP | 2010-138809 | A | 6/2010 |
| JP | 2010-185323 | A | 8/2010 |

* cited by examiner

ATTACHING METHOD OF FUEL RAIL ASSEMBLY FOR DIRECT-INJECTION ENGINE

BACKGROUND OF THE INVENTION

The present invention relates to an attaching method of a fuel rail assembly for a direct-injection engine.

Conventionally, a direct-injection engine which injects fuel directly through a fuel injector projecting into a combustion chamber of the engine is known in vehicles, such as automotive vehicles. In an inline type of direct-injection engine equipped with plural cylinders arranged in line, high-pressure fuel is supplied to respective fuel injectors for the plural cylinders via a fuel rail. This fuel rail comprises a rail member extending straightly along a cylinder-line direction to supply the fuel therethrough, plural cup portions to deliver the fuel from the rail member to the respective fuel injectors, and plural boss portions to fasten the fuel rail to a cylinder head thereby, which delivers the fuel from a fuel pump of the engine to the respective fuel injectors for the plural cylinders.

When the fuel injectors are attached to the engine, a fuel rail assembly in which the fuel injectors are attached to the fuel rail in advance is formed, and then this fuel rail assembly is fastened to the cylinder head with plural bolts corresponding to the respective cylinders. Each of the fuel injectors of the fuel rail assembly is inserted into the cup portion via a base-end-portion seal ring member arranged at a base-end portion of the fuel injector, that is, the fuel injector is arranged in a so-called one-sided support state. Therefore, there is a concern that a small-diameter cylindrical portion at a tip portion of the fuel injector may not be correctly positioned in its injector-insertion hole, so that the small-diameter cylindrical portion of the fuel injector may interfere with the cylinder head improperly. Therefore, a positioning adjustment of the fuel injector is generally conducted prior to pressing and inserting the small-diameter cylindrical portion of the fuel injector into the injector-insertion hole.

Japanese Patent Laid-Open Publication No. 2010-19132 discloses an attaching method of a fuel rail assembly, in which a fastening receiving seat is formed at a cylinder head, a bar-shaped guide member which is detachable relative to a screw hole formed at the fastening seat is provided, and a detachable stopper member is provided at a midway portion of the guide member which corresponds to where a tip of a small-diameter cylindrical portion of a fuel injector approaches an injector-insertion hole. Herein, after the above-described guide member inserted into a boss hole of the above-described boss portion of the fuel rail assembly is attached to the above-described screw hole of the fastening receiving seat, the fuel rail assembly is moved toward the cylinder head along the guide member. Then, when this move of the fuel rail assembly is restricted by the stopper member, the position of the fuel injector relative to the injector-insertion hole is adjusted and the stopper member is detached, the small-diameter cylindrical portion of the injector is pressed and inserted into the injector-insertion hole, then bolts are fastened to the boss portion.

The attaching method of a fuel rail assembly disclosed in the above-described patent document has a concern that even if the fuel injector is adjusted at a proper position in the stage of moving toward the cylinder head, the fuel rail assembly may not be effectively fastened relative to the cylinder head due to its structure when the small-diameter cylindrical portion of the fuel injector is pressed and inserted into the injector-insertion hole.

First, it may be difficult to press the fuel rail and the plural fuel injectors together against the cylinder head by fastening the plural boss portions provided at the fuel rail with the bolts. Secondly, it may be difficult to align the axial center of the fuel injector with the axial center of the injector-insertion hole. That is, a processing error of the cup portions and a processing error of the injector-insertion holes may be accumulated complexly, so that an improper difference in position between the axial center of the fuel injector inserted into the cup portion and the axial center of the injector-insertion hole may occur.

The above-described first problem may be solved by providing spring members to provide a biasing force to overcome a combustion-pressure reaction force between the plural cup portions of the fuel rail and the plural fuel injectors, whereby proper attaching of the fuel injectors can be conducted by the biasing force of the spring members. Further, the above-described second problem may be solved by proving a holding ring which comprises a taper face and a ring-shaped contact portion having a line contact with the taper face between the fuel injector and the head-side seating portion, whereby the difference in position between the axial center of the fuel injector and the axial center of the injector-insertion hole can be properly absorbed (adjusted). In a case in which the axial center of the fuel injector slants relative to the axial center of the injector-insertion hole, the holding ring can adjust the contact position of the taper face with the ring-shaped contact portion with a reaction force of the base-end-portion seal ring member occurring in a perpendicular direction to the axial center of the fuel injector. That is, the fuel injector can be stably seated in a face of the head-side seating portion via the holding ring in spite of the axial center of the fuel injector slanting relative to the axial center of the injector-insertion hole.

In the attaching method of the above-described fuel rail assembly, the fuel rail assembly is formed by inserting the fuel injectors equipped with the holding rings into the cup portions of the fuel rail via the spring members, this fuel rail assembly is pressed toward the cylinder head and the fuel injectors are pressed and inserted into the injector-insertion holes, and then the plural boss portions of the rail member are fastened and fixed to the respective fastening receiving seats. In an actual manufacturing process, from a work-efficiency perspective, the plural fuel injectors are pressed and inserted concurrently, and then the fuel rail assembly is fastened to the fastening receiving seats of the cylinder head with plural bolts for the respective cylinders by using a multiple nut runner capable of concurrently fastening.

The above-described press inserting step can be easily achieved by pressing the rail member with a specified pressing apparatus. However, since the axial center of the fuel injector is restricted by the injector-insertion hole via the base-end-portion seal ring member, the difference in position between the fuel injector and the injector-insertion hole may cause a slant of the axial center of the fuel injector relative to the axial center of the injector-insertion hole. Thus, if the press and insertion direction of the rail member slants in a longitudinal direction of the rail member, there occurs some difference in a compressive reaction force between the respective spring members. Accordingly, if a frictional force between the holding ring and the head-side seating portion exceeds the reaction force of the base-end-portion seal ring member occurring in the perpendicular direction to the axial center of the fuel injector, the move (displacement) of the holding ring in the perpendicular direction to the axial center of the fuel injector becomes not adjustable, so that the position of the axial center of the fuel injector is restricted. In a case in which the axial-center position of a specified fuel injector is restricted with its slating toward a certain direction in the press inserting step, if the fuel rail is compulsorily moved toward the cylinder head prior to completion of this step, the difference (error) in the axial center between the fuel injector and the cup portion increases. Thus, there is a concern that the axial-center difference (error) of the above-described specified fuel injector may deteriorate extremely more than that of the other fuel injector. Additionally, in a case in which the timings of fastening bolts improperly vary in a fastening step after the press inserting step, there is a concern that the difference (error) in the axial center between the fuel injector and the cup portion may further increase.

Herein, while it may be considered that a pressing force of the rail member is cancelled once in a previous step prior to the fastening step, this cancelation merely causes a temporary releasing of the biasing force of the spring member, so that there is a concern that the axial-center difference (error) of the fuel injector may occur again when the re-press inserting step or the fastening step restart. Therefore, when the positional difference between the fuel injector and the cup portion is improperly large, there exists a portion where a face pressure in a peripheral face between the base-end-portion seal ring member and the cup portion decreases, in particular, the hardness of the base-end-portion seal ring member increases in a cold engine-operational state. Thus, there is a concern that the fuel seal may deteriorate at the portion with the decreased face pressure.

SUMMARY OF THE INVENTION

An object of the present invention is to provide an attaching method of a fuel rail assembly for a direct-injection engine which can prevent any deterioration of the fuel seal which may be caused by the positional difference (error) of the fuel injector when the fuel rail assembly is assembled.

According to the present invention, there is provided an attaching method of a fuel rail assembly for a direct-injection engine equipped with plural cylinders arranged in line, in which a fuel rail comprises a rail portion extending straightly along a cylinder-line direction, plural cup portions to receive base-end portions of respective fuel injectors for the plural cylinders therein via a base-end-portion seal ring member respectively, and plural boss portions to be fastened and fixed to a cylinder head of the engine, and each of the fuel injectors comprises a cylindrical body portion having a taper face which is formed at a periphery thereof such that a diameter thereof becomes smaller toward a tip side thereof, a holding ring which comprises a ring-shaped contact portion to have a line contact with the taper face and is capable of adjusting an axial center of the fuel injector by changing a contact position thereof, and a small-diameter cylindrical portion extending toward an injector's tip portion from the cylindrical body portion and arranging the base-end-portion seal ring member around a periphery thereof, the attaching method comprising an assembly forming step of forming a fuel rail assembly by inserting the fuel injectors into the respective cup portions of the fuel rail via the respective base-end-portion seal ring members and respective spring members to provide a biasing force to overcome an combustion-pressure reaction force, a press inserting step of pressing and inserting respective tip-side portions of the fuel injectors into respective injector-insertion holes formed at the cylinder head by pressing the fuel rail at plural positions in a longitudinal direction of the fuel rail toward the cylinder head such that the respective spring members are compressed up to a middle compressive state thereof with a pressing movable apparatus which is capable of pressing the fuel rail at the plural positions in the longitudinal direction of the fuel rail toward the cylinder head via pressing springs capable of pressing and deforming the respective spring members, and a fastening step of fastening the plural boss portions of the fuel rail concurrently to the cylinder head in a state in which a pressing force of the press inserting step is maintained.

According to the above-described attaching method of a fuel rail assembly for a direct-injection engine, in the press inserting step, the respective spring members can generate the compressive reaction forces substantially equally, any situation where the compressive reaction force of any specified spring member may increase greatly compared with the other spring members can be properly restrained, so that the frictional force between the holding ring and the head-side seating portion can be suppressed below the reaction force of the base-end-portion seal ring member occurring in the perpendicular direction to the axial center of the fuel injector. Thereby, the appropriate position adjustment of the holding ring can be ensured, any improper decrease of the face pressure in the peripheral direction between the base-end-portion seal ring member provided at the cylindrical body portion and the cup portion can be prevented. Consequently, any deterioration of the fuel seal which may be caused by the positional difference (error) of the fuel injector can be prevented.

According to an embodiment of the present invention, the fastening step comprises a two-stage fastening with a fasting apparatus having plural fastening heads which correspond to plural fastening members to fasten the plural boss portions respectively, the two-stage fastening being configured such that a fastening torque of the plural fastening heads is increased up to a first torque value in a first state and then the fastening torque of the plural fastening heads is increased up to a second torque value which is greater than the first torque value. Thereby, the fuel rail assembly can be fastened concurrently, it can be prevented that the restraint of the holding ring occurs at a specified fuel injector in an early stage in the fastening step, and the positional difference (error) of the fuel injector can be prevented, thereby further preventing the deterioration of the fuel seal.

According to another embodiment of the present invention, the fuel rail includes plural pressure-receiving portions for press inserting corresponding to the plural cup portions, and the pressing movable apparatus presses the pressure-receiving portions via the respective pressing springs which are configured to generate an elastic force equivalent to an elastic force of said spring members.

Other features, aspects, and advantages of the present invention will become apparent from the following description which refers to the accompanying drawings.

DETAILED DESCRIPTION OF THE INVENTION

Hereinafter, a preferred embodiment of the present invention will be described referring to FIGS. 1-9.

Figure 4:
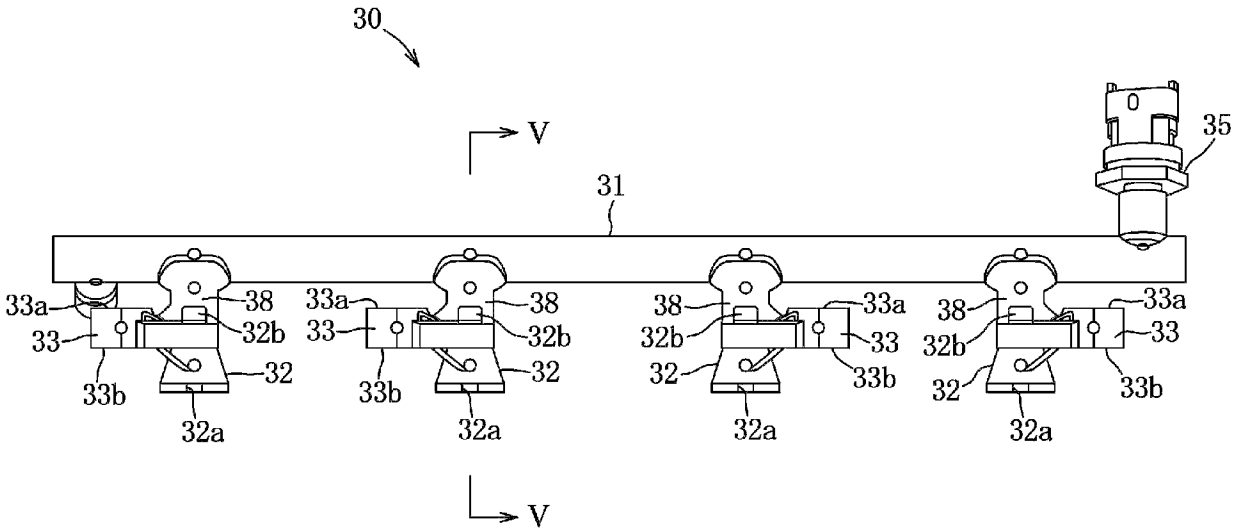
FIG. 4 is an elevational view of a fuel rail.

A direct-injection engine 1 is an inline four-cylinder engine equipped with four cylinders arranged in line along a direction of a crankshaft (not illustrated) as shown in FIG. 4. The engine 1 comprises a cylinder block 2, a cylinder head 3, and others. The cylinder block 2 comprises a cylinder liner 4, a piston 5 reciprocating vertically in the cylinder liner 4, and others for each cylinder.

The cylinder head 3 comprises two intake ports (not illustrated), two exhaust ports (not illustrated), intake and exhaust valves (not illustrated) to open or close these ports, an ignition plug 6, a fuel injector 20, and others for each cylinder. An upper face of the piston 5 positioned at a top dead center and a pent roof-shaped lower face of the cylinder head 3 form together a combustion chamber 7 for each cylinder. The engine 1 introduces intake air into the combustion chamber 7 of each cylinder, injects high-pressure fuel into the intake air in the combustion chamber 7 through the fuel injector 20, and then activates an ignition operation of the ignition plug 6, whereby a combustion cycle is formed.

Figure 1:
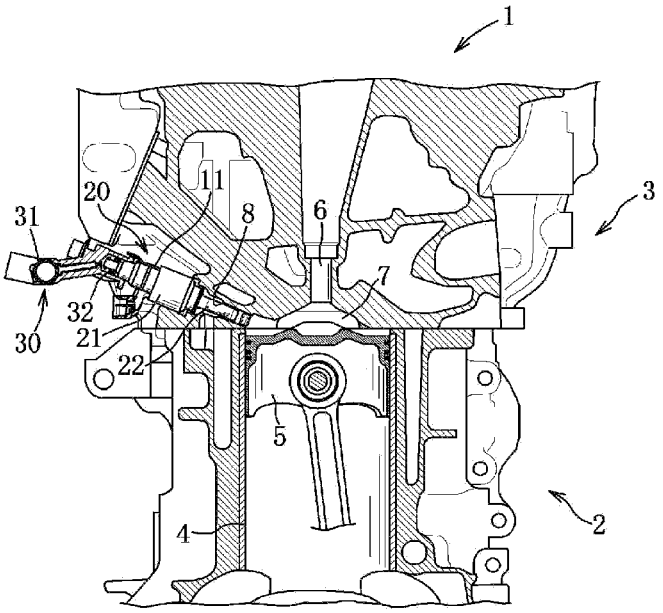
FIG. 1 is a partial sectional view showing a cylinder head of a direct-injection engine according to an embodiment of the present invention.
Figure 2:
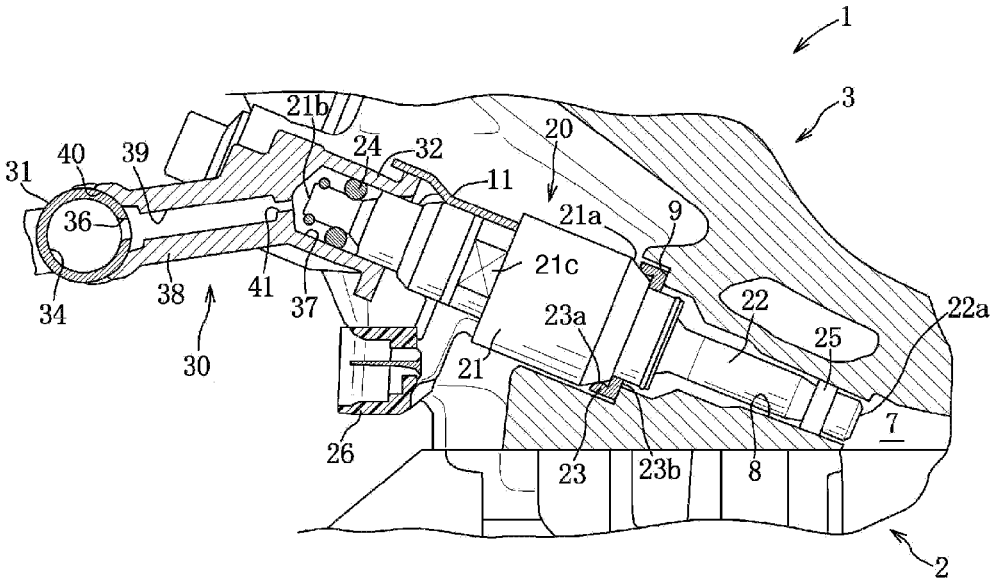
FIG. 2 is an enlarged sectional view of a major part of FIG. 1.

As shown in FIGS. 1 and 2, an injector-insertion hole 8 is formed at the cylinder head 3 for each cylinder, into which the fuel injector 20 is pressed and inserted. The injector-insertion hole 8 is configured to extend straightly from the combustion chamber 7 to the outside of the engine 1 and have its diameter which becomes greater toward its outside portion which is located away from the combustion chamber 7. At an outside-end position of the injector-insertion hole 8 which is located away from the combustion chamber 7 is formed a head-side seating portion 9 of the fuel injector 20.

Figure 3:
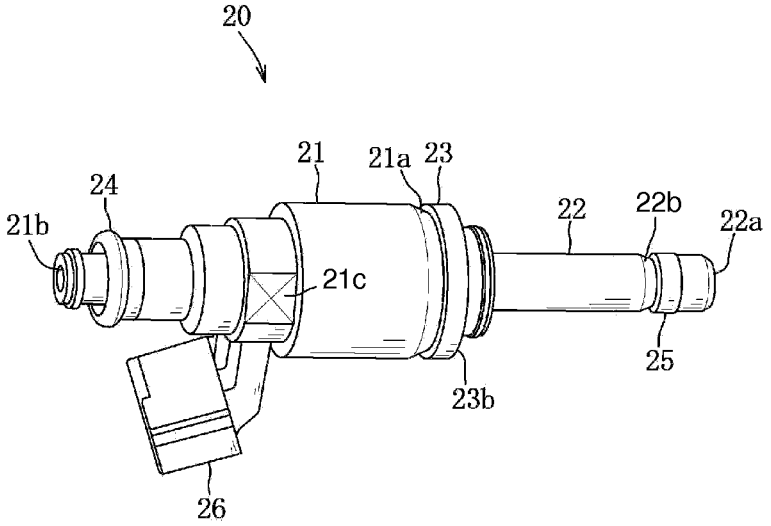
FIG. 3 is a perspective view of a fuel injector.

As shown in FIGS. 1-3, the four fuel injectors 20 for the respective cylinders are coupled to a fuel pump (not illustrated) of the engine 1 via a fuel rail 30 which extends in the cylinder line direction. Each fuel injector 20 comprises a cylindrical body portion 21, a small-diameter cylindrical portion 22 having a diameter which is smaller than that of the cylindrical body portion 21, a holding ring 23, and others. As shown in FIGS. 2 and 3, the cylindrical body portion 21 comprises a base-end-portion seal ring member 24 (an 0 ring, for example) which is provided entirely around its base end portion and has a specified elastic property, a taper face 21*a* which is provided at a periphery of its tip portion such that the diameter thereof becomes smaller toward its tip side, a fuel-introduction opening 21*b*, an electromagnetic coil portion (not illustrated), a synthetic-resin made connector 26 which protects a terminal to supply an electric power to the electromagnetic coil portion, and others.

Figure 7:
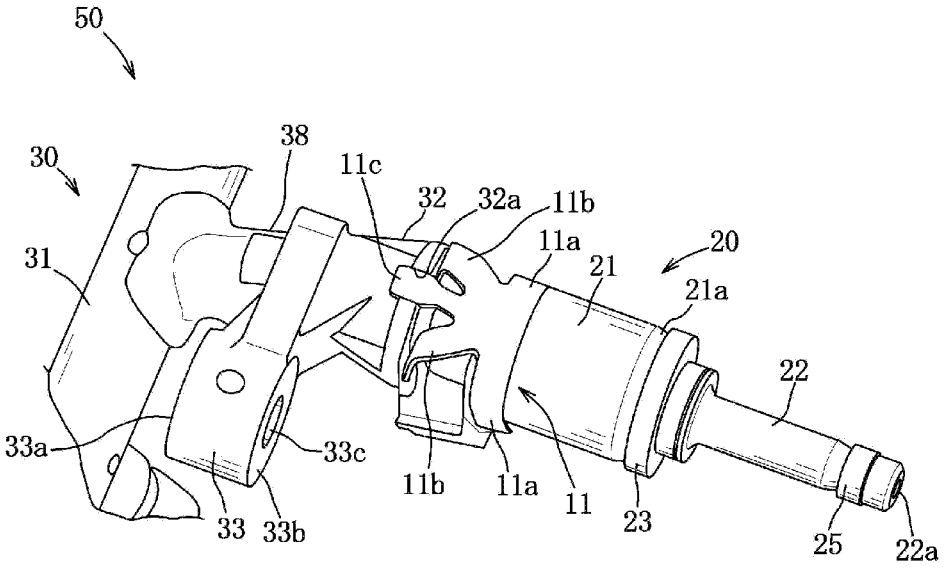
FIG. 7 is a perspective view of a major part of FIG. 6.

As shown in FIGS. 2, 3 and 7, the small-diameter cylindrical portion 22 extends from a tip of the cylindrical body portion 21 toward a tip thereof, and its tip end projects into the combustion chamber 7. The small-diameter cylindrical portion 22 comprises a valve member (not illustrated), a spring (not illustrated) to bias the valve member toward a valve-closing direction, an injection hole 22*a* provided at the tip thereof to inject the fuel therethrough.

A tip-end-portion seal ring member 25 which is made from fluoric resin (Teflon (trademark) seal, for example) is provided around a groove portion 22*b* of the tip end portion of the small-diameter cylindrical portion 22. Thus, when the electric power is supplied to the terminal of the connector 26, the valve body opens against the biasing force of the spring, so that the fuel having a high pressure (about 20 MPa, for example) filled in the fuel rail 30 is injected into the combustion chamber 7 through the injection hole 22*a*.

As shown in FIG. 2, the holding ring 23 is configured to have an arc-shaped cross section projecting toward the cylindrical body portion 21, and comprises a ring-shaped contact portion 23*a* having a ring-shaped line contact with the taper face 21*a* and a ring-side seating portion 23*b* having a flat face. The holding ring 23 is configured to stably press the fuel injector 20 against the head-side seating portion 9 of the cylinder head 3 with a biasing force of a spring member 11, which will be described later, through an appropriate change of a relative position between the taper face 21*a* and the ring-shaped contact portion 23*a* even if the axial center of the fuel injector 20 slants relative to the axial center of the injector-insertion hole 8. Herein, the head-side seating portion 9 is configured such that its seat face is properly wide in its radial direction compared with the radius of the holding ring 23.

Thereby, when any load by the biasing force of the above-described spring member 11 toward the combustion chamber 7 does not act on the cylindrical body portion 21, the ring-shaped contact portion 23*a* and the taper face 21*a* contact each other in a state in which they are located away from each other or the positioning of the cylindrical body portion 21 is not conducted (in a state in which the cylindrical body portion 21 is movable relative to the holding ring 23). Meanwhile, when the load by the biasing force of the spring member 11 toward the combustion chamber 7 acts on the cylindrical body portion 21, the ring-side seating portion 23*b* comes to have the face contact with the head-side seating portion 9, so that the positioning of the holding ring 23 relative to the cylinder head 3 is conducted by the frictional force acting in a direction perpendicular to the axial center of the injector-insertion hole 8. Accordingly, the ring-shaped contact portion 23*a* has a ring-shaped line contact with the taper face 21*a*, the position of the cylindrical body portion 21 is adjusted in the injector-insertion hole 8 via the holding ring 23.

Figure 5:
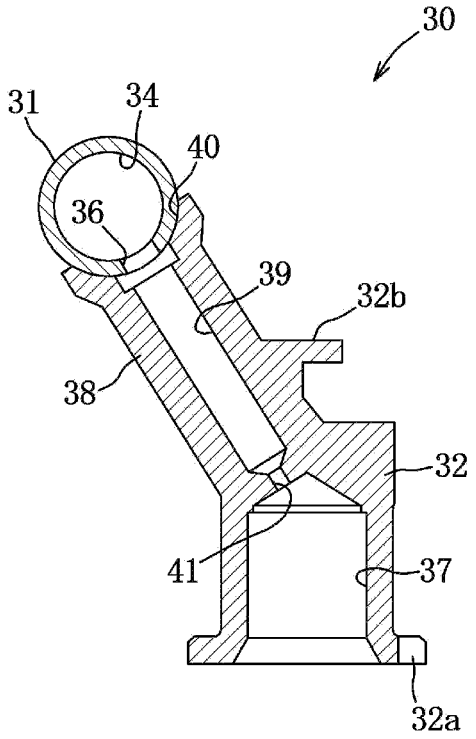
FIG. 5 is a sectional view taken along line V-V of FIG. 4.

As shown in FIGS. 4 and 5, the fuel rail 30 comprises a rail member (rail portion) 31, four cup portions 32 which are provided for the respective cylinders, four boss portions 33 which formed integrally with the cup portions 32, and others. The rail member 31 extends straightly along the cylinder line direction for supplying the fuel from the fuel pump. This rail member 31 is made of a tube-shaped pipe member which is made from a stainless-steel based material, and comprises a passage 34 which extends in its longitudinal direction thereinside, an introduction port 35 which is formed at a one-end portion of the passage 34, and four opening portions 36 which open toward a perpendicular direction to the longitudinal direction of the rail member 31 at respective positions corresponding to the respective fuel injectors 20.

Each cup portion 32 comprises a notch portion 32*a* which is formed at a peripheral face of a tip portion thereof, a pressure-receiving portion 32*b* which is formed at a middle-step portion thereof, an injector-accommodation portion 37 in the shape of a cylinder with a floor (bottom), and a passage portion 38 which is formed between the injector-accommodation portion 37 and the rail member 31. The notch portion 32*a* and the pressure-receiving portion 32*b* are positioned substantially coaxially with the axial center of the fuel injector 20 in an elevational view of the rail member 31 (see FIG. 4), and the pressure-receiving portion 32*b* is positioned substantially right above a central position of the fuel injector 20 in its plan view (see FIG. 5). The injector-accommodation portion 37 is configured to receive a base-end portion of the cylindrical body portion 21 therein via the base-end-portion seal ring member 24. Accordingly, when the fuel injector 20 is inserted into the cup portion 32, a face pressure corresponding to an insertion force of this fuel injector occurs between an inner peripheral face of the injector-accommodation portion 37 and an outer peripheral face of the base-end-portion seal ring member 24, and the high-pressure fuel is filled in a sealed space between the injector-accommodation portion 37 and the base-end portion of the cylindrical body portion 21.

As shown in FIGS. 2 and 5, the passage portion 38 connects the passage 34 and the injector-accommodation portion 37 so as to supply the fuel from the passage 34 to the injector-accommodation portion 37. The passage portion 38 extends in perpendicular to the rail member 31, and comprises a straight delivery passage 39, a curve-shaped joint portion 40, and a connecting passage 41 which has a diameter smaller than that of the delivery passage 39. A curved face of the joint portion 40 is joined to an outer peripheral face of the rail member 31 by soldering, so that the delivery passage 39 and the opening portion 36 are interconnected. Thereby, the fuel supplied to the rail member 31 is delivered from the respective opening portions 36 for the cylinders into the respective delivery passages 39, and then supplied to the respective fuel injectors 20 for the cylinders via the respective connecting passages 41.

Figure 8:
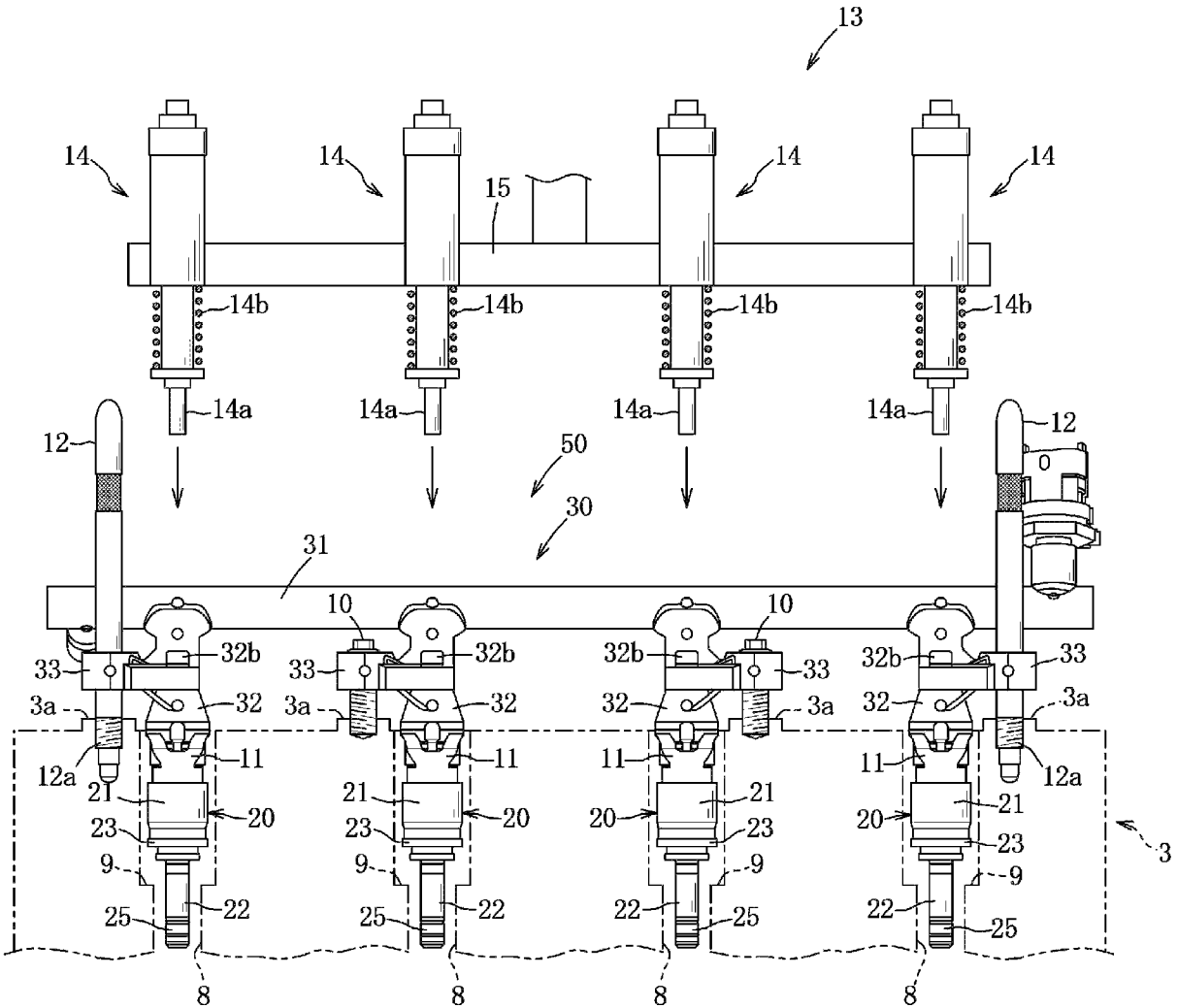
FIG. 8 is a diagram showing a press inserting step.
Figure 9:
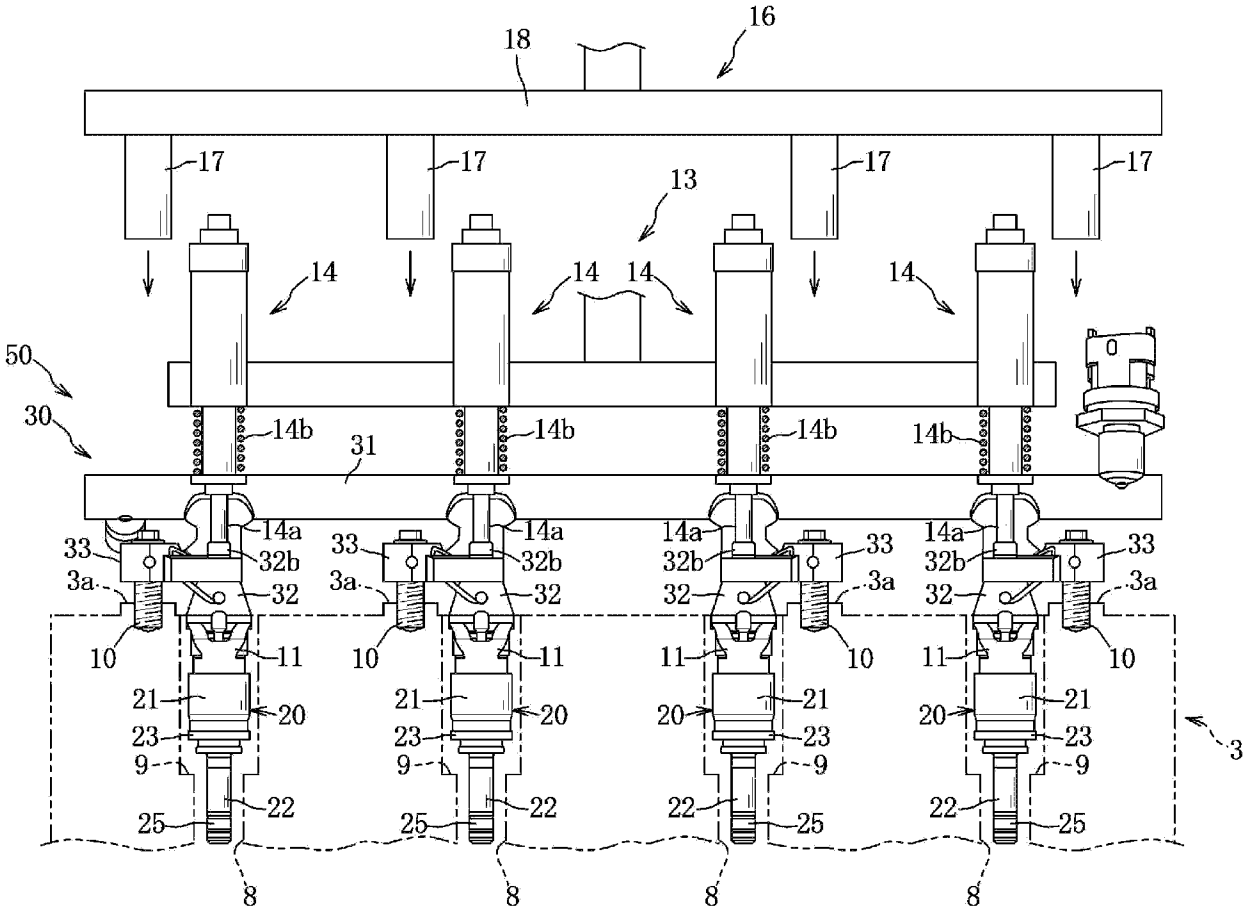
FIG. 9 is a diagram showing a fastening step.

As shown in FIGS. 4 and 7, each boss portion 33 is formed integrally, extending from a midway portion of the passage portion 38 for each cylinder in parallel to the rail member 31. The boss portion 33 is configured such that the axial center thereof is substantially parallel to the axial center of the injector-accommodation portion 37 and substantially perpendicular to the axial center of the rail member 31. The boss portion 33 comprises flat-shaped upper and lower faces 33*a*, 33*b* and a boss hole 33*c* which penetrates the upper and lower faces 33*a*, 33*b*. As shown in FIGS. 8 and 9, the boss portion 33 is fastened to a fastening seat 3*a* of the cylinder head 3 with a bolt 10. Thus, the lower face 33*b* of the boss portion 30 is fixed to an upper face of the fastening seat 3*a*, so that a fastening force of the bolt 10 is transmitted to the injector 20 via the rail member 31 and the spring member 11 which will be described later.

Figure 6:
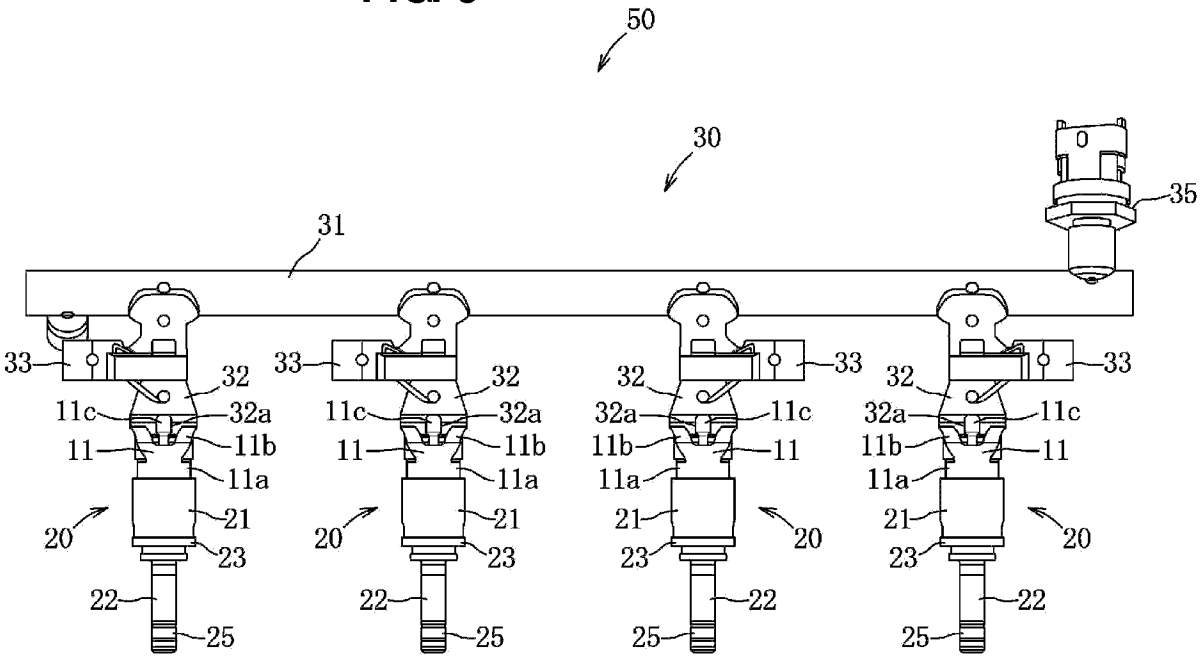
FIG. 6 is an elevational view of a fuel rail assembly.

As shown in FIGS. 6 and 7, each fuel injector 20 is assembled to the cylinder head 3 in a state of the fuel rail assembly 50. The fuel rail assembly 50 is configured such that each fuel injector 20 is inserted into each cup portion 32 of the fuel rail 30 via each spring member 11. Thus, the fuel injector 20 is supported in the one-sided support state at the fuel rail 30, specifically at the cup portion 32.

The spring member 11 is configured to provide a biasing force which can make the fuel injector 20 overcome a combustion-pressure reaction force as shown in FIG. 7. The spring member 11 is made from spring steel, and comprises a pair of right-and-left engagement portions 11*a* which engages with the fuel injector 20, a pair of deformation portions 11*b* which contacts a lower end portion of the cup portion 32 and is elastically deformable, and an engaging portion 11*c* which engages with the notch portion 32*a*. The pair of engagement portions 11*a* is formed in substantially a U shape in a plan view, and engages with the fuel injector 20 in such a manner that the pair of flat side faces 21*c* of the base-end side portion of the cylindrical body portion 21 of FIG. 2 is restricted between the pair of engagement portions 11*a*.

The pair of deformation portions 11*b* is configured to curve substantially in parallel to the pair of engagement portions 11*a*. The deformation portions 11*b* have spring characteristics such that when a pressing force of the small-diameter portion 22 into the injector-insertion hole 8 acts on the deformation portions 11*b* in a compressive direction, the deformation portions 11*b* deform to a middle compressive state thereof, more specifically to an initial compressive state thereof (about a compressive state of about 2 mm, for example) and generate a specified elastic force (200 N, for example), and when the bolt fastening to the boss portion 33 is completed, the deformation portions 11*b* deform more largely than the above-described compressive state and generate a larger elastic force (600 N, for example). The engaging portion 11*c* extends from a middle position between the pair of deformation portions 11*b* in a direction perpendicular to the extension direction of the engagement portions 11*a* and the deformation portions 11*b*. The specified positioning (direction or phase) of the fuel injector 20 relative to the cup portion 32 is determined by making the engaging portion 11*c* with the notch portion 32*a* and restricting the pair of the engagement portions 11*a* by the pair of flat side faces 21*c* of the cylindrical body portion 21. Thereby, the pattern of the fuel injected into the combustion chamber from the fuel injector 20 can be made appropriate.

Next, steps of attaching the fuel rail assembly 50 to the engine 1 will be described referring to FIGS. 6, 8 and 9. These steps comprise an assembly forming step, a press inserting step, and a fastening step.

In the assembly forming step, as shown in FIG. 6, the fuel rail assembly 50 is formed by inserting the four fuel injectors 20 into the injector-accommodation portion 37 of the four cup portions 32 via the four spring members 11. Herein, the engaging portion 11*c* of the spring member 11 engages with the notch portion 32*a*, so that the axial center of the fuel injector 20 is disposed substantially coaxially with the axial center of the cup portion 32.

In the press inserting step, as shown in FIG. 8, the fuel rail assembly 50 is moved toward the cylinder head 3 until the four spring members 11 becomes the middle (initial) compressive state, so that the tip-end-portion seal ring members 25 of the four fuel injectors 20 are pressed and inserted into the respective injector-insertion holes 8. In this press inserting step, a pair of guide tools 12 and a pressing movable apparatus 13 which can press the fuel rail assembly 50 toward the combustion chamber 7 are used.

The guide tool 12 is formed in a circular rod shape so as to be inserted into the boss hole 33*c* of the boss portion 33. A male screw portion 12*a* which engages with a screw portion of the fastening seat 3*a* is formed at a one end of the guide tool 12. The pressing movable apparatus 13 comprises four pressing members 14, a moving member 15 which can move the four pressing members 14 in a state in which these members 14 are arranged in line along the cylinder-line direction, and others. Each pressing member 14 comprises a pressing portion 14*a* which can press the pressure-receiving portion 32*b* toward the combustion chamber 7, a compressive spring 14*b* (i.e., a pressing spring) which can elastically support the pressing portion 14*a*, and others. The compressive spring 14*b* has spring characteristics which can generate an elastic force equivalent to an elastic force of the spring member 11 (200 N, for example).

The pair of guide tool 12 is screwed into the screw portions of the fastening seats 3*a* for the first and fourth cylinders for fixation. The pair of guide tool 12 is inserted into the boss holes 33*c* for the first and fourth cylinders, and the boss holes 33*c* for the second and third cylinders and the corresponding fastening seats 3*a* are temporarily fastened by the bolts 10 with providing no torque. Next, the pair of guide tool 12 is detached from the screw portions of the fastening seats 3*a* for the first and fourth cylinders, and the boss holes 33*c* for the first and fourth cylinders and the corresponding fastening seats 3*a* are temporarily fastened with the bolts 10. Herein, the position adjustment of the fuel injectors 20 is conducted before the temporary fastening of the bolts 10 in a case in which the small-diameter cylindrical portion 22 is not properly positioned relative to the injector-insertion hole 8. Thereby, the in-advance positioning of the fuel rail assembly 50 relative to the cylinder head 3 is conducted.

Next, the moving member 15 is moved, so that all of the pressing portions 14*a* contact the respective upper portions of the corresponding pressure receiving portions 32*b* and all of the fuel injectors 20 are concurrently pressed toward the combustion chamber 7 via the cup portions 32 and the spring members 11. Herein, the pressing movable apparatus 13 controls to drive the moving member 15 by a specified load (800 N, for example) capable of pressing and inserting the tip-end-portion seal ring members 25 of the respective fuel injectors 20 into the injector-insertion holes 8. Herein, the respective spring members 11 are in the middle (initial) compressive state prior to the maximum compressive state, and there occur situations in which the axial center (axial line) of the fuel injectors 20 slants relative to the axial center (axial line) of the injector-insertion holes 8 due to the difference in position between the injector-insertion holes 8 at the cylinder head 3 and the cup portions 32 (the injector-accommodation portions 37) at the fuel rail 30 and the like. However, the fuel rail 30 moves properly keeping its parallel position while the respective pressure receiving portions 32*b* are receiving the pressing load which is almost equal over its entire longitudinal length due to the respective compressive springs 14*b*. Thus, there occurs no improper slant, so that no improperly-large compressive reaction force occurs at any specified spring member. Therefore, the frictional force between the ring-side seating portion 23*b* of the holding ring 23 and the head-side seating portion 9 of the cylinder head 3 which occurs in the perpendicular direction to the axial line of the fuel injector 20 does not exceed the elastic reaction force of the base-end-portion seal ring member 24. Accordingly, the fuel injectors 20 can be pressed stably against the cylinder head 3 with an appropriate follow-up operation of the holding rings 23 in a state in which the fuel injectors 20 slant relative to the injector-insertion holes 8. Thereby, the holding rings 23 of the fuel injectors 20 seat onto the respective head-side seating portions 9, and the tip-end-portion seal ring members 25 of the respective fuel injectors 20 are pressed and inserted into the respective injector-insertion holes 8 up to their appropriate positions.

As shown in FIG. 9, the fastening step is executed in a state in which the pressing movable apparatus 13 is pressed. In the fastening step, the four boss portions 33 are concurrently fastened to the cylinder head 3 by the pressing movable apparatus 13 in a state in which the four spring members 11 are in the middle (initial) compressive state. This fastening step uses a fastening apparatus 16 which is comprised of a multiple nut runner which comprises four fastening heads 17 corresponding to the four bolts 10 for fastening the four boss portions 33 and a moving member 18 movable in a state in which the fastening heads 17 are arranged along the cylinder-line direction. Herein, the fastening apparatus 16 is illustrated schematically in FIG. 9.

Keeping the state in which the specified load capable of pressing and inserting the respective tip-end-portion seal ring members 25 is made act on the fuel rail assembly 50 by the pressing movable apparatus 13, that is—the state in which the respective spring members 11 are in the middle (initial) compressive state, the moving member 18 is moved, so that all of the bolts 10 are concurrently fastened by the fastening heads 17.

All of the fastening heads 17 are driven and rotated when the four fastening heads 17 contact the respective bolts 10, this drive control is continued until the fastening torque of the fastening heads 17 increases up to a first torque value (3 Nm, for example), so that all of bolt fastening portions reach the first torque value in order. When the fastening torque of the all fastening heads 17 have reached the first torque value, a target torque is changed from the first torque value to a second torque value (7 Nm, for example), and the drive control is continued until the fastening torque of the all fastening heads 17 increases up to the second torque value. Then, this drive control is maintained until the fastening torque of the fastening heads 17 increases up to a final torque value (22-26 Nm, for example). The fastening work is completed when the fastening torque of the all fastening heads 17 has reached the final torque value.

In this fastening step, every bolt 10 is fastened stepwise according to the concurrent bolt fastening, without completing fastening of part of the bolts prior to fastening of the other bolds, so that there occurs no improperly-large difference in the compressive reaction force among the respective spring members 11. Therefore, fastening of the respective bolts is completed further equally, keeping the state in which the holding rings 23 of the respective fuel injectors 20 seat at the corresponding head-side seating portions 9 in the press inserting step. After the fastening of all of the bolts 10 is completed, the pressing movable apparatus 13 and the fastening apparatus 16 are moved away from the fuel rail assembly 50, so that the assembling of the fuel rail assembly 50 is completed.

Hereafter, the operations/effects of the attaching method of the fuel rail assembly 50 according to the present embodiment will be described. In the attaching method of the fuel rail assembly 50, in the press inserting step, the fuel rail 30 is pressed toward the cylinder head 3 by using the pressing movable apparatus 13 which can press the fuel rail 30 at the plural positions in its longitudinal direction via the plural compressive springs 14*b* having the elastic forces capable of compressively deforming the spring members 11 and equivalent to the elastic forces of the spring members 11. Accordingly, the respective spring members 11 can generate the compressive reaction force substantially equally, so that the frictional force between the holding ring 23 and the head-side seating portion 9 can be suppressed below the reaction force of the base-end-portion seal ring member 24 occurring in the perpendicular direction to the axial center of the fuel injector. Thereby, the appropriate position adjustment of the holding ring 23 can be ensured, any improper decrease of the face pressure in a peripheral direction between the base-end-portion seal ring member 24 provided at the cylindrical body portion 21 and the cup portion 32 can be prevented. Consequently, the deterioration of the fuel seal which is caused by the positional difference (error) of the fuel injector 20 can be prevented.

In the fastening step, the fasting apparatus 16 having the plural fastening heads 17 which correspond to the plural bolts 10 to fasten the plural boss portions 33 respectively is used, and the fastening torque of the plural fastening heads 17 is increased up to the first torque value and then increased up to the second torque value which is greater than the first torque value. Thereby, the fuel rail 30 can be moved keeping its stable and parallel position without slanting relative to the longitudinal direction of the fuel rail 30, so that any improperly-large difference in the compressive reaction force among the spring members 11 can be restrained, the positional difference (error) between the fuel injectors 20 and the injector-insertion accommodation portions 37 can be prevented, thereby further preventing the deterioration of the fuel seal.

The present invention should not be limited to the above-described embodiment, and any other further modifications or improvements may be applied within the scope of a sprit of the present invention.

For example, while the example of the inline four-cylinder engine is described in the above-described embodiment, any type of multi-cylinder direct-injection engine may be applied as long as at least the fuel rail assembly is assembled to the engine, such as an inline six-cylinder engine or a V-type six-cylinder engine.

Further, the example of the pressing movable apparatus comprising the plural compressive springs capable of generating the equivalent elastic force to the elastic force of the spring members is described in the above-described embodiment, any pressing movable apparatus which can press the fuel rail via right-and-left two or plural compressive springs capable of generating the elastic force which is greater than the elastic force of the spring members may be used.

What is claimed is:

1. An attaching method of a fuel rail assembly for a direct-injection engine equipped with plural cylinders arranged in line, in which a fuel rail comprises a rail portion extending straightly along a cylinder-line direction, plural cup portions to receive base-end portions of respective fuel injectors for the plural cylinders therein via a base-end-portion seal ring member respectively, and plural boss portions to be fastened and fixed to a cylinder head of the engine, and each of the fuel injectors comprises a cylindrical body portion having a taper face which is formed at a periphery thereof such that a diameter thereof becomes smaller toward a tip side thereof, a holding ring which comprises a ring-shaped contact portion to have a line contact with the taper face and is capable of adjusting an axial center of the fuel injector by changing a contact position thereof, and a small-diameter cylindrical portion extending toward an injector's tip portion from the cylindrical body portion and arranging the base-end-portion seal ring member around a periphery thereof, the attaching method comprising:

an assembly forming step of forming a fuel rail assembly by inserting the fuel injectors into the respective cup portions of the fuel rail via the respective base-end-portion seal ring members and respective spring members to provide a biasing force to overcome an combustion-pressure reaction force, wherein each spring member is interposed between each fuel injector and each cup portion of the fuel rail and configured to be elastically deformable when receiving a compressing force such that a distance between the fuel injector and the cup portion is shortened;

a press inserting step of pressing and inserting respective tip-side portions of the fuel injectors into respective injector-insertion holes formed at the cylinder head by pressing the fuel rail at respective pressure-receiving portions which are formed at the respective cup portions of the fuel rail toward the cylinder head such that said respective spring members are compressed and deformed up to a middle compressive state thereof with a pressing movable apparatus via pressing springs capable of pressing and deforming the respective spring members, wherein each spring member receives the compressive force for compressing and deforming the spring member which is derived from a pressing force of the fuel rail by said pressing movable apparatus and transmitted to the spring member by way of the cup portion of the fuel rail; and a fastening step of fastening said plural boss portions of the fuel rail concurrently to the cylinder head in a state in which a pressing force of said press inserting step is maintained so that said spring members keep said middle compressive state.

2. The attaching method of a fuel rail assembly for a direct-injection engine of claim 1, wherein said fuel rail includes plural pressure-receiving portions for press inserting corresponding to said plural cup portions, and said pressing movable apparatus presses the pressure-receiving portions via said respective pressing springs which are configured to generate an elastic force equivalent to an elastic force of said spring members.

3. The attaching method of a fuel rail assembly for a direct-injection engine of claim 1, wherein each of said pressure-receiving portions formed at the cup portions of the fuel rail is positioned substantially right above a central position of each of said fuel injectors.

4. The attaching method of a fuel rail assembly for a direct-injection engine of claim 1, wherein each of said pressure-receiving portions is formed at a middle-step portion which is positioned between an injector-accommodation portion of each of said cup portion and said fuel rail.

5. The attaching method of a fuel rail assembly for a direct-injection engine of claim 1, wherein each of said spring members comprises an engagement portion which engages with said fuel injector and a deformation portion which is formed integrally with the engagement portion, the deformation portion being configured to project toward said cup portion from the engagement portion and then bend toward an axial center of the fuel injector.

6. An attaching method of a fuel rail assembly for a direct-injection engine equipped with plural cylinders arranged in line, in which a fuel rail comprises a rail portion extending straightly along a cylinder-line direction, plural cup portions to receive base-end portions of respective fuel injectors for the plural cylinders therein via a base-end-portion seal ring member respectively, and plural boss portions to be fastened and fixed to a cylinder head of the engine, and each of the fuel injectors comprises a cylindrical body portion having a taper face which is formed at a periphery thereof such that a diameter thereof becomes smaller toward a tip side thereof, a holding ring which comprises a ring-shaped contact portion to have a line contact with the taper face and is capable of adjusting an axial center of the fuel injector by changing a contact position thereof, and a small-diameter cylindrical portion extending toward an injector's tip portion from the cylindrical body portion and arranging the base-end-portion seal ring member around a periphery thereof, the attaching method comprising:

an assembly forming step of forming a fuel rail assembly by inserting the fuel injectors into the respective cup portions of the fuel rail via the respective base-end-portion seal ring members and respective spring members to provide a biasing force to overcome an combustion-pressure reaction force;

a press inserting step of pressing and inserting respective tip-side portions of the fuel injectors into respective injector-insertion holes formed at the cylinder head by pressing the fuel rail at plural positions in a longitudinal direction of the fuel rail toward the cylinder head such that said respective spring members are compressed up to a middle compressive state thereof with a pressing movable apparatus which is capable of pressing the fuel rail at the plural positions in the longitudinal direction of the fuel rail toward the cylinder head via pressing springs capable of pressing and deforming the respective spring members; and a fastening step of fastening said plural boss portions of the fuel rail concurrently to the cylinder head in a state in which a pressing force of said press inserting step is maintained, wherein said fastening step comprises a two-stage fastening with a fasting apparatus having plural fastening heads which correspond to plural fastening members to fasten said plural boss portions respectively, the two-stage fastening being configured such that a fastening torque of the plural fastening heads is increased up to a first torque value in a first state and then the fastening torque of the plural fastening heads is increased up to a second torque value which is greater than the first torque value.

7. The attaching method of a fuel rail assembly for a direct-injection engine of claim 6, wherein said fuel rail includes plural pressure-receiving portions for press inserting corresponding to said plural cup portions, and said pressing movable apparatus presses the pressure-receiving portions via said respective pressing springs which are configured to generate an elastic force equivalent to an elastic force of said spring members.

* * * * *